United States Patent [19]

Temmesfeld et al.

[11] Patent Number: 4,823,862

[45] Date of Patent: Apr. 25, 1989

[54] PLASTIC RADIATOR FOR TRANSVERSE-FLOW COOLING SYSTEMS OF INTERNAL COMBUSTION ENGINES

[75] Inventors: Axel Temmesfeld, Bad Feilnbach; Karl Tauber, Munich, both of Fed. Rep. of Germany

[73] Assignee: Bayerische Motoren Werke Aktiengesellschaft, Munich, Fed. Rep. of Germany

[21] Appl. No.: 46,879

[22] PCT Filed: Dec. 4, 1985

[86] PCT No.: PCT/EP85/00664

§ 371 Date: Apr. 17, 1987

§ 102(e) Date: Apr. 17, 1987

[87] PCT Pub. No.: WO86/03555

PCT Pub. Date: Jun. 19, 1986

[30] Foreign Application Priority Data

Dec. 5, 1984 [DE] Fed. Rep. of Germany ..... 3444275

[51] Int. Cl.[4] ..... F28D 15/00

[52] U.S. Cl. ..... 165/104.32; 123/41.54

[58] Field of Search ..... 123/41.54; 165/104.32

[56] References Cited

U.S. PATENT DOCUMENTS 4,492,267 1/1985 Cadars ..... 123/41.54
4,723,596 2/1988 Spindelboeck ..... 123/41.54

FOREIGN PATENT DOCUMENTS 0047352 3/1982 European Pat. Off. .
2709940 9/1978 Fed. Rep. of Germany .

*Primary Examiner*—Carroll B. Dority, Jr.
*Attorney, Agent, or Firm*—Barnes & Thornburg

[57] ABSTRACT

Molded to a plastic water chamber for transverse-flow radiators of internal-combustion engines is the lower part of a two part storage, air venting and balancing chamber, through which an ancillary coolant flow passes, and wherein the normal range of the coolant level is located at an upper part of the balancing chamber which is connected to the lower part of the balancing chamber, and wherein said upper part is transparent for observation of the coolant level.

4 Claims, 1 Drawing Sheet

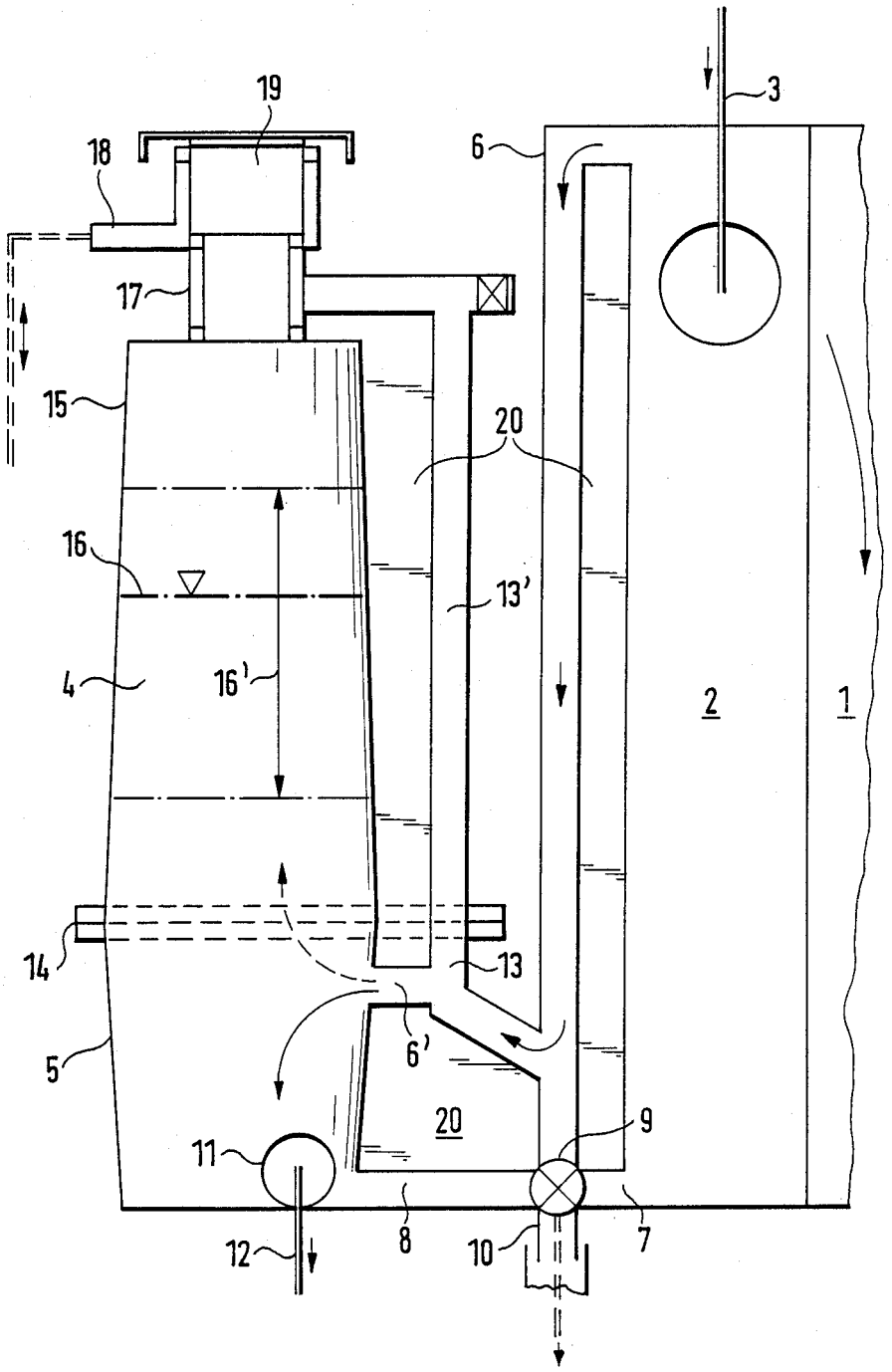
19
18
17
15
16
4
16'
14
5
11
12
8
10
7
9
20
6'
13
13'
20
6
3
2
1

PLASTIC RADIATOR FOR TRANSVERSE-FLOW COOLING SYSTEMS OF INTERNAL COMBUSTION ENGINES

BACKGROUND OF THE INVENTION

The invention relates to a balancing chamber of an internal combustion engine cooling system and more particularly to a multi-piece balancing chamber which has a transparent upper portion about the normal fill level of coolant, whereby the level of coolant in the cooling system can easily be observed.

In the case of a water chamber known according to German Offenlegungsschrift DE-OS No. 27 09 940 of a construction that has a plastic water chamber for a radiator of an internal combustion engine, a transparent window is arranged or cast during manufacturing into the wall of the balancing chamber that is otherwise integral with the water chamber. Since the main part of the balancing chamber is largely opaque, the coolant level is hardly visible against the dark interior of the chamber and can therefore not be reliably observed from the usual viewing distance.

It is the objective of the invention to develop the partially transparent chamber is such a way that the coolant level is always more clearly visible from the usual viewing distance.

In order to achieve this objective, a plastic water chamber means is integrally connected to a first portion of a balancing chamber means which balancing chamber means has an upper transparent portion connected to the first portion at a level below the normal range of coolant levels in the balancing chamber means. In this manner, the monitoring of the coolant level corresponds to a monitoring that is carried out with a fully transparent chamber that is arranged separately from the water chamber without having its additional space requirements and construction expenditures for its multipart development, for connecting lines and fastening elements. In addition, the invention makes it possible to, on the one hand, develop the water chamber so that the bottom part of the chamber is made of a high-strength fiber-reinforced and therefore opaque plastic material and to, on the other hand, construct the transparent upper part with a pressure-proof approximately circular cross-section.

The combination with the suggestion according to German Patent Application 34 30 115.1 corresponding to U.S. Pat. No. 4,723,596, issued Feb. 9, 1988 that relates to a balancing tank with a pressurized chamber and an atmospheric chamber, results in a development in which the coolant level in both chambers is clearly visible, and the constructional expenditures for the additional balancing and storage chamber is restricted to the additional requirement of material and an additional simple lid.

These and other objects, features, and advantages of the present invention will become more apparent from the following description when taken in conjunction with the accompanying drawing which shows, for the purposes of illustration only, one embodiment in accordance with the present invention, and wherein:

BRIEF DESCRIPTION OF THE DRAWINGS

The FIGURE drawing shows a schematic embodiment of the invention wherein a plastic water chamber with an added-on coolant balancing tank for transverse-flow radiators of internal-combustion engines is depicted.

DETAILED DESCRIPTION OF THE DRAWINGS

Referring now to the drawing wherein like reference numerals are used to designate like parts, a transverse-flow radiator 1 for an internal-combustion engine (that is not shown) has a water chamber with a forward-flow water fill line 3 for filling of the cooling circuit of the internal-combustion engine. A storage, air venting and balancing chamber 4 is built on to the water chamber 2. The lower part 5 of said storage, air venting and balancing chamber 4 is molded out and integral with the water chamber 2 and is made of a break-proof fiber-reinforced plastic material. Also molded integrally onto the water chamber 2 are an air venting line 6, discharge lines 7 and 8 respectively for the water chamber 2 and the balancing chamber 4, a discharge valve housing 9 and a discharge connection piece 10. Molded to the bottom part 5 of the balancing chamber 4 that is an integral part of the water chamber 2 are: a hose connection piece 11 for a filling and ancillary-flow return-flow line 12 to the internal combustion engine, the junction 6', a branching means 13 leading from the venting line 6 to the control line 13', and a connecting surface for an upper part 15 of the balancing chamber which surface is located in an approximately horizontal parting plane 14. The upper part 15 of the balancing chamber 4, in contrast to its lower part 5 and the water chamber 2, consists of a transparent plastic material of lower firmness. This lower firmness is compensated by an approximately circular cross-sectional shape of the upper part 15 so that the excess pressure values occurring during the operation of the internal-combustion engine in the balancing chamber 4 can be reliably absorbed. The parting plane 14 between the lower part 5 and the upper part 15 is located below the coolant level 16 so that the coolant level 16, can be ascertained in the transparent upper part 15 in a clearly visible way even from a long distance. A filler neck 17 is molded integrally to the upper part 15 of the balancing chamber and to a portion, of the control line 13' and of an overflow line 18. The filler neck 17 is closed by a filler lid 19 that in a known way contains valves for the pressure control of the cooling circuit.

The sections of the venting line 6' and of the control line 13' are made integral by molding to the two plastic molded parts (bottom 5 and water chamber 2) by means of webs 20 from the outside. The control line 13', at the parting plane 14, connects to the branch-off means 13 from the venting line 6' so that separate connecting elements are not necessary. The venting line 6' and the control line 13' in the practical implementation may be arranged behind one another in viewing direction of the drawing, wherein a space-saving close arrangement of the water chamber 2 and the balancing chamber 4 can be achieved.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claim.

We claim:

1. A plastic water chamber means for transverse-flow radiators of internal combustion engines, comprising: at least a two part balancing chamber means through which an ancillary flow of coolant passes, a water chamber means fluidly connected to the balancing chamber means, a first part of the two part balancing chamber means being made integrally with the water chamber means, the balancing chamber means in an area corresponding to a normal range of coolant level within the water chamber means, having a second and transparent part wherein the second transparent part is an upper part that is connected on the first part that is integral with the water chamber means at a point below the normal range of coolant level.

2. A plastic water chamber means of claim 1, wherein the first and upper parts of the balancing chamber means and the water chamber means are all plastic with the plastic of the first part and the water chamber means having a greater strength than the plastic of the top part.

3. A plastic water chamber means of claim 1, wherein the upper part of the balancing chamber means is configured with a circular cross-sectional area extending substantially throughout its length.

4. A plastic water chamber means of claim 2, wherein the upper part of the balancing chamber means is configured with a circular cross-sectional area extending substantially throughout its length.

* * * * *